US008151527B2

(12) United States Patent
Gosling et al.

(10) Patent No.: US 8,151,527 B2
(45) Date of Patent: Apr. 10, 2012

(54) SYSTEM FOR PROVIDING BOTH PARTIAL-HEIGHT AND FULL-HEIGHT WALL MODULES

(75) Inventors: Geoff Gosling, Calgary (CA); Mogens F. Smed, DeWinton (CA)

(73) Assignee: Dirtt Enviromental Solutions, Ltd., Calgary (CA)

( * ) Notice: Subject to any disclaimer, the term of this patent is extended or adjusted under 35 U.S.C. 154(b) by 211 days.

(21) Appl. No.: 12/135,028

(22) Filed: Jun. 6, 2008

(65) Prior Publication Data

US 2008/0302054 A1 Dec. 11, 2008

Related U.S. Application Data

(60) Provisional application No. 60/942,932, filed on Jun. 8, 2007.

(51) Int. Cl.
*E04H 1/00* (2006.01)

(52) U.S. Cl. ..... 52/238.1; 52/239; 52/241; 52/266; 52/270; 52/284

(58) Field of Classification Search ..... 52/238.1, 52/239, 241, 266, 270, 264, 271, 284
See application file for complete search history.

(56) References Cited

U.S. PATENT DOCUMENTS 3,037,593 A 6/1962 Webster
3,180,459 A * 4/1965 Liskey, Jr. ..... 52/474
4,356,672 A 11/1982 Beckman et al.
4,438,614 A 3/1984 Raith et al.
4,631,881 A * 12/1986 Charman ..... 52/220.7
4,852,317 A 8/1989 Schiavello et al.
4,905,428 A * 3/1990 Sykes ..... 52/126.4
4,916,876 A 4/1990 Schuyler
5,152,113 A 10/1992 Guddas
5,524,402 A * 6/1996 Sykes ..... 52/243.1
5,600,926 A 2/1997 Ehrlich
5,642,593 A 7/1997 Shieh
5,682,719 A 11/1997 Huang
5,746,034 A * 5/1998 Luchetti et al. ..... 52/220.7
5,746,035 A * 5/1998 Seiber et al. ..... 52/238.1
5,822,935 A 10/1998 Mitchell et al.
5,930,963 A * 8/1999 Nichols ..... 52/239
6,012,258 A * 1/2000 Brown et al. ..... 52/239
6,058,667 A * 5/2000 MacDonald et al. ..... 52/239
6,250,032 B1 6/2001 Davis et al.
6,260,321 B1 7/2001 Rudduck
6,282,854 B1 9/2001 Vos et al.
6,341,457 B1 1/2002 Aerts et al.
6,481,168 B1 11/2002 Hodges et al.
6,591,563 B2 7/2003 King et al.
D485,368 S 1/2004 Hayashi
6,675,382 B1 * 1/2004 Foster ..... 717/177
6,729,085 B2 5/2004 Newhouse et al.
6,802,171 B2 10/2004 McKinnon
(Continued)

*Primary Examiner* — Brian Glessner
*Assistant Examiner* — Adam Barlow
(74) *Attorney, Agent, or Firm* — Workman Nydegger

(57) ABSTRACT

A system for providing both partial-height and full-height wall modules can include a plurality of wall module portions. The plurality of wall module portions can include lower wall module portions and upper wall module portions. A lower wall portion can be configured with a top bracket upon which a trim cap can be placed to form a partial-height wall module. One or more upper wall module portions can also be stacked on the lower wall module portion to form a full-height wall module.

20 Claims, 4 Drawing Sheets

U.S. PATENT DOCUMENTS

| | | | | |
|---|---|---|---|---|
| 6,883,277 | B2 | 4/2005 | Wiechecki et al. | |
| 6,920,727 | B2 | 7/2005 | Yu et al. | |
| 7,017,311 | B2 * | 3/2006 | Weiss | 52/271 |
| 7,434,790 | B1 | 10/2008 | Hansen | |
| 7,461,484 | B2 * | 12/2008 | Battey et al. | 52/220.7 |
| 8,024,901 | B2 | 9/2011 | Gosling et al. | |
| 2002/0108330 | A1 | 8/2002 | Yu et al. | |
| 2002/0157335 | A1 * | 10/2002 | Vos | 52/238.1 |
| 2003/0089057 | A1 | 5/2003 | Wiechecki et al. | |
| 2003/0221384 | A1 * | 12/2003 | Burken et al. | 52/238.1 |
| 2004/0020137 | A1 | 2/2004 | Battey et al. | |
| 2004/0035074 | A1 * | 2/2004 | Stanescu et al. | 52/481.2 |
| 2004/0177573 | A1 | 9/2004 | Newhouse et al. | |
| 2006/0059806 | A1 * | 3/2006 | Gosling et al. | 52/238.1 |
| 2006/0185276 | A1 * | 8/2006 | Pai | 52/238.1 |
| 2008/0295426 | A1 * | 12/2008 | Milligan et al. | 52/238.1 |

* cited by examiner

SYSTEM FOR PROVIDING BOTH PARTIAL-HEIGHT AND FULL-HEIGHT WALL MODULES

CROSS-REFERENCE TO RELATED APPLICATIONS

This application claims the benefit of U.S. Provisional Patent Application Ser. No. 60/942,932, filed Jun. 8, 2007, entitled "A SYSTEM FOR PROVIDING BOTH PARTIAL-HEIGHT AND FULL-HEIGHT WALL MODULES," the entire contents of which are incorporated herein by reference.

BACKGROUND OF THE INVENTION

1. Technical Field

The present disclosure relates generally to wall modules and reconfigurable combinations of walls.

2. Background and Relevant Art

Office space can be relatively expensive, not only due to the basic costs of the location and size of the office space, but also due to any construction needed to configure the office space in a particular way. For example, an organization might purchase or rent a large open space in an office complex, and then subdivide or partition the open space into various offices, conference rooms, or cubicles, depending on the organization's needs and size constraints. Rather than having to find new office space and move as an organization's needs change, it is often necessary to have a convenient and efficient means to reconfigure the existing office space. Many organizations address their configuration and reconfiguration issues by dividing large, open office spaces into individual work areas using modular walls and partitions.

In particular, at least one advantage of modular systems is that they are relatively easy to configure. In addition, another advantage is that modular systems can be less expensive to set up, and can be reconfigured more easily than more permanently constructed office dividers. For example, a set of offices and a conference area can be carved out of a larger space in a relatively short period of time with the use of modular systems. If needs change, the organization can readily reconfigure the space.

Manufacturers or assemblers of modular spaces generally assemble a plurality of wall modules together to create partitions, rooms, or the like in a space (e.g., a large room with sub-dividable space). The manufacturer will assemble the partitions or rooms by connecting two or more wall modules together about one or more connectors, such as one or more connector posts. The created partitions may then be used as offices, booths, or any number of purposes, and can be rearranged into any number of different designs with some ease.

At times, it may be desirable to provide walls of differing heights as part of a modular wall system. In some applications, a full-height wall may be desirable. For example, when creating a modular space where it is desirable to limit the exposure of the modular space to outside sources of sound and/or light, such as in a conference room where private meetings may be held, full-height walls are typically desirable. In other applications, a partial-height wall may be desirable, which may make use of a partial-height or short wall module. For example, when creating multiple modular spaces wherein each modular space does not have its own individual light source, such as a window or overhead light, it may be desirable to construct the modular spaces using partial-height wall modules so that multiple modular spaces benefit from the limited light sources available. One such example of partial-height modular spaces may include conventional cubicle arrangements.

Conventionally, separate modular wall systems are used for providing full-height wall modules and partial-height wall modules. Each modular wall system typically requires a number of unique adapters. In order to couple the separate modular wall systems together, additional adapters may also be required. As a result, the use of separate wall systems for partial and full-height wall modules, each with its own unique adapters, may increase the number of components a manufacturer produces, thus requiring that the manufacturer have separate manufacturing tools and processes for the separate wall systems. Similarly, using separate wall systems for partial and full-height wall modules increases the number of components an assembler is forced to stock in order to meet full-height and partial-height wall applications. Accordingly, manufacturing and assembling a combination of partial and full-height wall modules can be inefficient and costly.

In addition to the disadvantages already mentioned, the differences between partial and full-height wall systems may affect the aesthetics of a modular space in undesirable ways. Because the separate systems operate independent of one another, they may not be designed to connect to each other in a seamless and aesthetically pleasing fashion. Connection of partial-height systems to full-height systems may create unattractive joints between the systems. As a result, in modular spaces where both full-height and partial-height modular walls are desired, the use of separate wall systems may result in an unsightly finished product.

Accordingly, these are a number of difficulties in providing modular walls/partitions, particularly where height designs and constraints may need to change.

BRIEF SUMMARY OF THE INVENTION

Implementations of the present invention overcome one or more problems in the art with systems, methods, and apparatus configured to provide flexibility in the design and installation of wall module systems. In particular, implementations of the present invention extend to a wall module system that can be configured for providing full-height wall modules and partial-height wall modules.

For example, implementations of the present invention include a system, in which wall module portions are combined in various configurations so as to provide both partial and full-height wall modules, thereby avoiding the need for multiple systems. In one implementation, the system has a plurality of wall module portions, including at least one lower wall module portion and at least one upper wall module portion. The lower wall module portion can include a top bracket configured to interface with an upper wall module portion, such that an upper wall module portion can be stacked on a lower wall module portion to form a full-height wall module. In one implementation, an upper wall module portion may include a bottom bracket that is configured to interface with the top bracket of a lower wall module portion. In a further implementation, the system can include a trim cap configured to interface with the top bracket of a lower wall module portion to form a partial-height wall module.

In addition, implementations of the present invention can also include a stackable wall module portion. In one implementation, the stackable wall module portion can include a panel with a top edge and a bottom edge. A top bracket can be coupled to the top edge of the panel, and a bottom bracket can be coupled to the bottom edge of the panel. The bottom bracket is configured to interface with the top bracket, such that two or more stackable wall module portions may be stacked together to form a full-height wall module.

In addition, implementations of the present invention can also include a method for creating partial or full-height wall modules. In one implementation, such a method includes placing a first wall module portion in a location where a partial or full-height wall module is desired. The first wall module portion can include a top bracket configured to interface with a trim cap to form a partial-height wall module or with the bottom surface of an additional wall module portion to form a full-height wall module. In addition, the method includes at least one of stacking a second wall module portion on top of the first wall module portion to create a full-height wall module, or coupling a trim cap with the top bracket of the first wall module portion to create a partial-height wall module.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Implementations of the present invention overcome one or more problems in the art with systems, methods, and apparatus configured to provide flexibility in the design and installation of wall module systems. In particular, the present invention extends to a wall module system for providing full-height wall modules and partial-height wall modules. For example, a single system is provided, in which wall module portions are combined in various configurations so as to provide both partial and full-height wall modules, thereby avoiding the need for multiple systems.

Accordingly, a manufacturer need not produce multiple systems, each with its own unique adapters and connectors, for providing both partial-height and full-height wall modules. As a result, a manufacturer can reduce the number of components the manufacturer produces, thereby avoiding the need for separate manufacturing tools and processes for the separate wall systems. As an additional result, an assembler can reduce the number of components the assembler stocks in order to provide full-height and partial-height wall modules.

In addition, the system, according to at least one implementation, can be configured to connect partial and full-height wall modules in a seamless and aesthetically pleasing fashion. In particular, the system can minimize or prevent unattractive joints commonly associated with the connection of partial-height systems to full-height systems, thereby resulting in a more attractive finished product.

Figure 1:
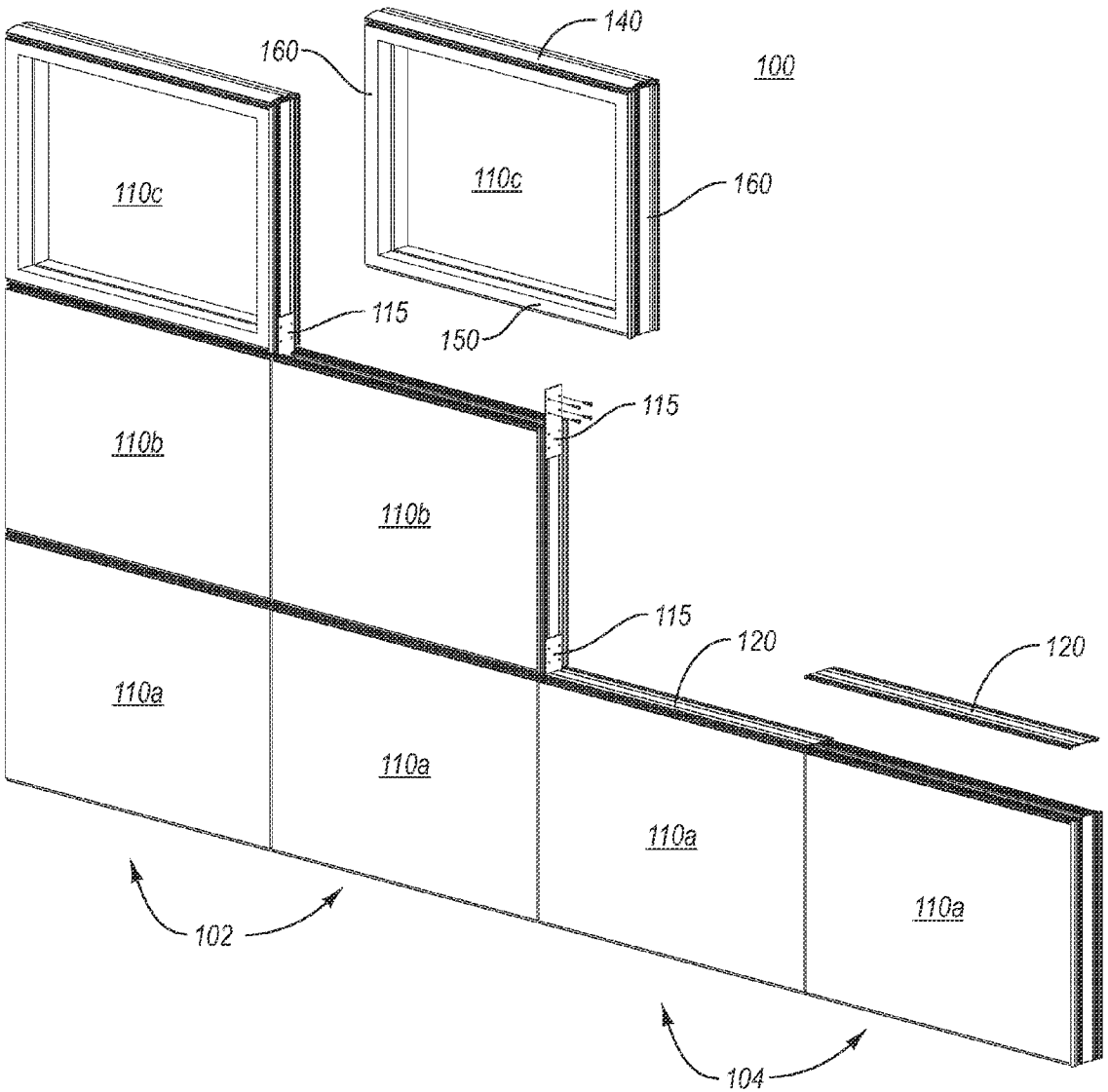
FIG. 1 illustrates a partially exploded view of a module wall system for providing both full-height wall modules and partial-height wall modules in accordance with an implementation of the present invention.

Referring now to the Figures, FIG. 1 illustrates a partially exploded view of one implementation of the wall module system 100 of the present invention. As shown, the wall module system 100 can include a plurality of wall module portions 110 (110*a*-110*c*), which an assembler can combine to form full-height wall modules 102 and partial-height wall modules 104.

In at least one implementation of the present disclosure, an assembler can construct a full-height wall module 102 using a lower wall module portion 110*a* and one or more upper wall module portions 110*b*, 110*c*. The full-height wall module 102 can be freestanding, or can alternatively be fixed in place by coupling the lower wall module portion 110*a* to a support surface structure, such as a floor or adjacent wall. Similarly, one of the upper wall module portions 110*b*, 110*c* can be coupled to an upper support surface structure, such as a ceiling. While FIG. 1 illustrates the use of multiple upper wall module portions 110*b*, 110*c* stacked upon a lower wall module portion 110*a* to form a full-height wall module 102, one will appreciate that a single upper wall module portion 110*b* or 110*c* can be stacked upon a lower wall module portion 110*a* to form the full-height wall module 102.

In order to facilitate the stacking of multiple wall module portions 110, the wall module portions 110 can comprise brackets (e.g., 140, 150, 160) (or "extrusions"), located along the horizontal and/or vertical edges of the wall module portions 110. In particular, the brackets (e.g., 140, 150, 160) can be elongated and extend along the full length and/or height of the wall module portion 110. In at least one implementation, a manufacturer can form the brackets (e.g., 140, 150, 160) using an extrusion process, in which a metallic material, such as aluminum, is extruded into the desired shape for the bracket. The manufacturer can further configure the brackets (e.g., 140, 150, 160) to interface with additional wall module portions 110 for creating full-height wall modules 102, or with trim caps 120 for creating partial-height wall modules 104.

For example, a lower wall module portion 110*a* can include a top bracket (e.g., 140) along the top surface of the lower wall module portion 110*a*. A manufacturer can configure the top bracket (e.g., 140) to interface with the bottom surface of an upper wall module portion 110*b*, 110*c*, such that an upper wall module portion 110*b*, 110*c* can be stacked on the lower wall module portion 110*a* to form a full-height wall module 102. Similarly, in at least one implementation, an upper wall module portion 110*b*, 110*c* can further comprise a bottom bracket (e.g., 150). In at least one implementation, a manufacturer can configure the bottom bracket (e.g., 150) to interface with the top bracket (e.g., 140) of a lower wall module portion 110*a*. In any event, an assembler can stack an upper wall module portion 110*b*, 110*c* upon a lower wall module portion 110*a* to form a full-height wall module 102.

Of course, one will appreciate that, in at least one implementation of the present invention, an upper wall module portion 110*b*, 110*c* can comprise both a bottom bracket (e.g., 150) and a top bracket (e.g., 140). In addition, a manufacturer can configure the multiple upper wall module portions 110*b*, 110*c* to be stacked together on top of a lower wall module portion 110*a* to form a full height wall module 102, as illustrated in FIG. 1. Similarly, in a further implementation of the present invention, a manufacturer can configure the multiple wall module portions 110 to be universally used as lower wall module portions 110*a* or as upper wall module portions 110*b*, 110*c*. For example, in at least one implementation, a manufacturer can configure the top and bottom surfaces of the multiple wall module portions 110 to interface together for stacking, such that any wall module portion 110 can be used as either a lower wall module portion 110*a* or as an upper wall module portion 110*b*, 110*c*. As a result, a manufacturer can improve the interchangeability of the multiple wall module portions 110 of the wall module system 100, and also minimize the number of different types of wall module portions 110 necessary for the wall module system 100.

As FIG. 1 further illustrates, the wall module portions 110 can include vertical brackets (e.g., 160) (or "vertical extrusions") along the vertical edges of the wall module portions 110. In one implementation, a manufacturer can configure the vertical brackets 160 to include features for interfacing with additional components for securing wall module portions 110 together. For example, FIG. 1 illustrates the use of splice plates 115 to secure wall module portions 110 together in a stacked manner. In particular, the vertical brackets 160 can include a channel or surface configured for receiving the splice plates 115 and to which an assembler can fasten the splice plates 115 using any number of fastening mechanisms, such as screws, clips, glue, and the like. These, in turn, allow the manufacturer/assembler to bridge the gap between two stacked wall module portions 110, and to secure the two wall module portions 110 together in a stacked manner to form a full-height wall module 102. One will appreciate that a manufacturer can form the splice plates 115 using any number of rigid materials. In at least one implementation, the splice plate 115 includes sheet metal, though substantially rigid plastics and other materials can also be used.

As further illustrated by FIG. 1, an assembler can form a partial-height wall module 104 using a lower wall module portion 110*a* and a trim cap 120. In at least one implementation, a manufacturer can configure the trim cap 120 to interface with the top surface of the lower wall module portion 110*a* in order to provide an aesthetically pleasing finish along the top surface of the partial-height wall module 104. For example, the manufacturer can configure the trim cap 120 to couple with the top bracket (e.g., 140) of the lower wall module portion 110*a*. One will appreciate that a manufacturer can form the trim cap 120 using any type of materials, such as plastic, wood, or metallic materials. In at least one implementation, the trim cap 120 can comprise extruded aluminum.

As FIG. 1 illustrates, an assembler can install a partial-height wall module 104 adjacent to a full-height wall module 102. As shown, a manufacturer can facilitate coupling a partial-height wall module 104 to a full-height wall module 102 by configuring the lower wall module portions 110*a* to be coupled together. For example, in at least one implementation, a manufacturer can configure the vertical brackets (e.g., 160) of the lower wall module portions 110*a* of the system 100 to be coupled together regardless of the type of wall module in which the lower wall module portions 110*a* are used, whether it be in a full-height wall module 102 or a partial-height wall module 104.

As a result, an assembler can couple a full-height wall module 102 to a partial-height wall module 104 by coupling their respective lower wall module portions 110*a* together. In at least one implementation, a manufacturer can further the capability of coupling multiple wall module portions 110 together by configuring the multiple wall module portions 110 to have the same width and same height. In a further implementation, and to improve the aesthetics of the transition between the different height wall modules, an assembler can install vertical trim (not shown) along the exposed vertical edge of an upper wall module portions 110*b*, 110*c* where a full-height wall module 102 transitions to a partial-height wall module 104.

Figure 3:
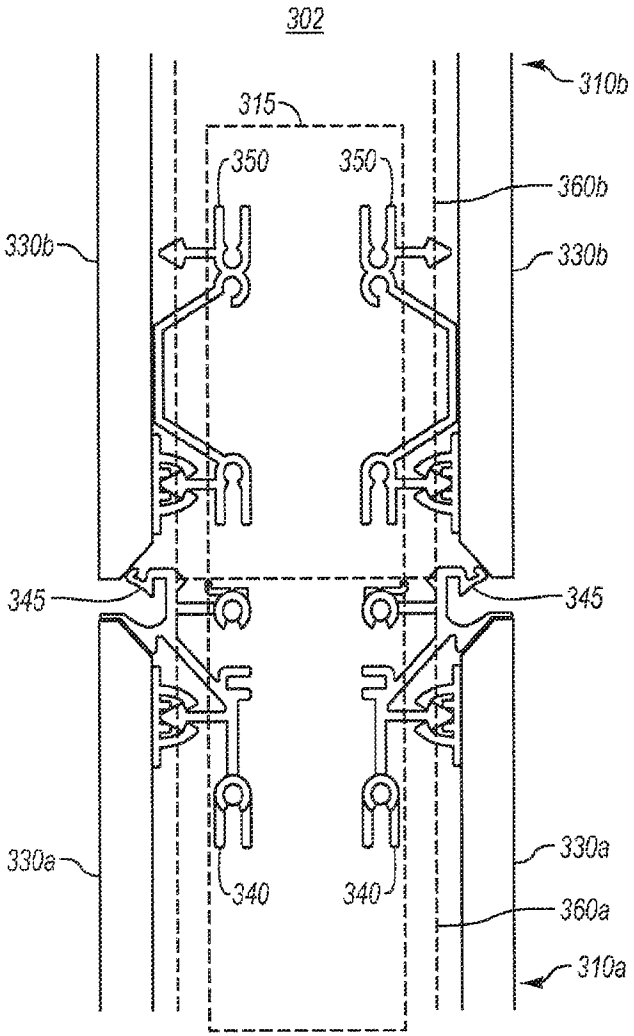
FIG. 3 illustrates a partial cross-sectional view of a full-height wall module with solid wall portions in accordance with an implementation of the present invention.
Figure 2:
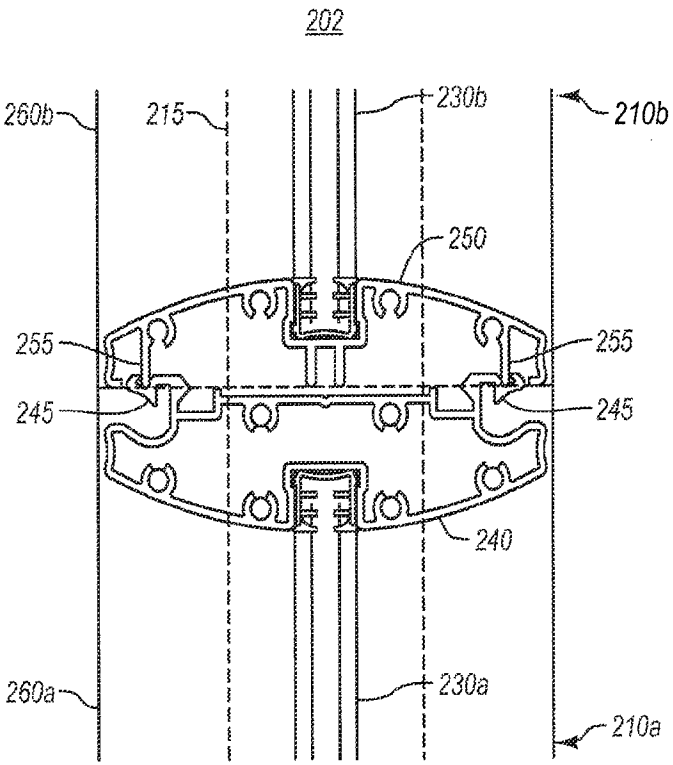
FIG. 2 illustrates a partial cross-sectional view of a full-height wall module with glass wall portions in accordance with an implementation of the present invention.

In general, the wall module portions 110 can further comprise panels (e.g., 230 and 330, FIGS. 2 and 3). The panels (e.g., 230 and 330, FIGS. 2 and 3) can be coupled panels (e.g., 330, FIG. 3) or unitary panels (e.g., 230, FIG. 2). In addition, the panels can be formed of solid materials (e.g., 330, FIG. 3), which are generally opaque, or can be formed of glass materials (e.g., 230, FIG. 2), which can be transparent or otherwise. For ease of reference, wall module portions 110 including solid panels may be referred to herein as solid wall module portions (e.g., 110*a*, 110*b*), while wall module portions 110 including glass panels may be referred to herein as glass wall module portions (e.g., 110*c*).

FIG. 2 illustrates a further embodiment of a full-height wall module 202. As a preliminary matter and by way of explanation, the elements of the full-height wall module 202 shown in FIG. 2 may be functionally similar to the elements of the full-height wall module 102 previously described above and shown in FIG. 1 in most respects. Nevertheless, certain features will not be described in relation to this embodiment for purposes of convenience, even though such components may function in the manner as described above and are hereby incorporated into this alternative embodiment described below. In general, like structures and/or components are given like reference numerals.

In any event, FIG. 2 illustrates a partial cross-sectional view of a full-height wall module 202 using glass wall module portions 210 according to at least one implementation of the present invention. The illustrated full-height wall module 102 includes a lower wall module portion 210*a* on which is stacked an upper wall module portion 210*b*. The lower wall module portion 210*a* illustrated in FIG. 2 includes a unitary glass panel 230*a*, a top bracket 240, and one or more vertical brackets 260*a*. As shown, the top bracket 240 is coupled to the top of the glass panel 230*a*. As further illustrated in FIG. 2, a manufacturer can configure the top bracket 240 to include various features which secure the top bracket 240 to the panel 230*a*. For example, a manufacturer can secure the top bracket 240 to the glass panel 230*a* using clips, fasteners, glues and the like. As is further shown, the top bracket 240 can include interfacing features 245 along its upper surface to interface with corresponding interfacing features 255 of the upper wall module portion 210*b*.

The upper wall module portion 210*b*, as illustrated in FIG. 2, includes a unitary glass panel 230*b*, a bottom bracket 250, and one or more vertical brackets 260*b*. In particular, the bottom bracket 250 couples to the bottom of the glass panel 230*b*. Similar to the illustrated top bracket 240, the bottom bracket 250 can include various features which secure the bottom bracket 250 to the glass panel 230*b*. As is further illustrated, the bottom bracket 250 of the upper wall module portion 210*b* can include interfacing features 255 to interface with corresponding interfacing features 245 of the top bracket 240 of the lower wall module portion 210*a*, such that an assembler can securely stack the upper wall module portion 210*b* upon the lower wall module portion 210*a*.

FIG. 2 further illustrates the use of a splice plate 215 to bridge the gap between the stacked wall module portions 210*a*, 210*b* and to secure the wall module portions 210*a*, 210*b* in a stacked manner. In at least one implementation, an assembler fastens the splice plate to the vertical brackets 260*a*, 260*b* of the wall module portions 210*a*, 210*b* to secure the wall module portions 210*a*, 210*b* together as is further shown in FIG. 1. Any number of fastening mechanisms can be used, including the use of screws, nails, clips, glues, and the like, to fasten the splice plate 215 to the wall module portions 210*a*, 210*b*. In a further implementation, and to improve the aesthetics of the full-height wall module 202, a manufacturer can configure the wall module portions 210*a*, 210*b* to seamlessly stack together so as to reduce or eliminate the break at the seam between the lower wall module portion 210*a* and the upper wall module portion 210*b*.

Similar to that shown in the preceding Figures, FIG. 3 illustrates a yet further embodiment of a full-height wall module 302. Specifically, FIG. 3 illustrates a partial cross-sectional view of a full-height wall module 302, albeit using solid wall module portions 310 rather than glass wall module portions (e.g., 210, FIG. 2). As shown, the full-height wall module 302 includes an upper wall module portion 310*b* stacked upon a lower wall module portion 310*a*. In particular, the lower wall module portion 310*a* includes multiple opposing top brackets 340, multiple coupled solid panels 330*a*, and one or more vertical brackets 360*a*. As is further illustrated, the upper wall module portion 310*b* includes multiple bottom brackets 350, multiple coupled solid panels 330*b*, and one or more vertical brackets 360*b*. As shown, the top and bottom brackets 340, 350 can include connecting features to secure the top and bottom brackets 340, 350 to the solid panels 330.

Although FIG. 3 illustrates the use of multiple solid panels 330 and multiple brackets 340, 350 for each solid wall module portion 310, one will appreciate that a manufacturer, in at least one implementation of the present invention, can configure the solid wall module portions 310 to only include a unitary solid panel 330 and/or a single top bracket 340 or bottom bracket 350.

As shown, the panels 330*b* of the upper wall module portion 310*b* can be configured in size and shape to abut the extending interfacing features 345 of the top bracket 340 of the lower wall module portion 310*a*. FIG. 3 shows that the interfacing features 345 of the top bracket 340 can securely hold the upper wall module portion 310*b* by interfacing with and supporting the bottom edges of the panels 330*b*. As FIG. 3 illustrates, the interfacing features 345 can include an angular surfaces to interface with and support the corresponding angular surfaces of the panels 330*b* to hold the upper wall module portion 310*b* in place on top of the lower wall module portion 310*a*. This relatively secure positioning allows the manufacturer/assembler to further secure the two wall module portions 310*a*, 310*b* together using one or more splice plates 315. In at least one implementation, an assembler stacks the wall module portions 310*a*, 310*b* together and then fastens the splice plate 315 to the vertical brackets 360*a*, 360*b* of the wall module portions 310*a*, 310*b* to secure the wall module portions 310*a*, 310*b* in a stacked position.

In a further embodiment, the bottom brackets 350 of the upper wall module portion 310*b* can include interfacing features similar to those of the bottom bracket shown in FIG. 2 (e.g., 255) to interface with the interfacing features 345 of the top bracket 340 of the lower wall module portion 310*a*, such that an assembler can stack the upper wall module portion 310*b* upon the lower wall module portion 310*a* to form the full-height wall module 302. Similarly, in a yet further implementation of the present invention, a manufacturer can configure the solid wall module portions 310*a*, 310*b* to be similar to glass wall module portions (e.g., 210, FIG. 2). Accordingly, and regardless of the type, whether glass or solid, a manufacturer can configure lower wall module portions (e.g., 110*a*, FIG. 1) and upper wall module portions (e.g., 110*b*, 110*c*, FIG. 1) to universally and interchangeably stack together to form full-height wall modules (e.g., 102, FIG. 1).

Figure 4:
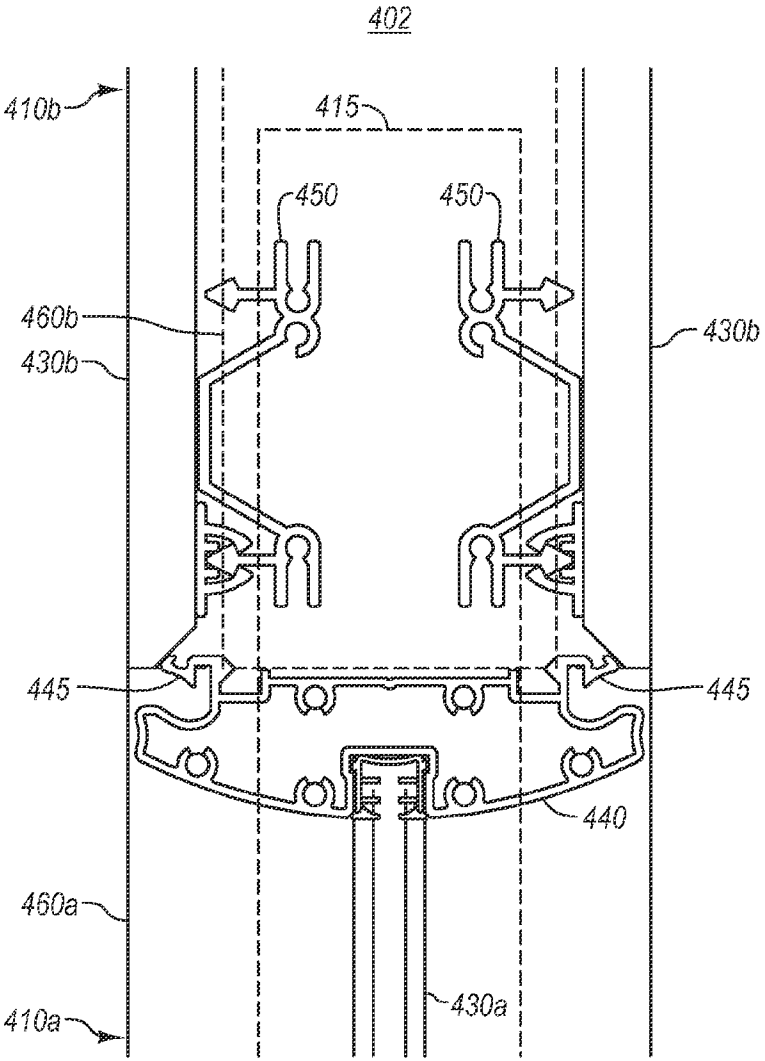
FIG. 4 illustrates a partial cross-sectional view of a full-height wall module with a solid wall portion stacked over a glass wall portion in accordance with an implementation of the present invention.

FIG. 4 illustrates a still further embodiment of a full-height wall module 402. As with FIGS. 2 and 3, FIG. 4 illustrates a partial cross-sectional view of a full-height wall module 402. In particular, FIG. 4 includes a solid wall module portion 410*b* stacked over a glass wall module portion 410*a* in accordance with an implementation of the present invention. The solid wall module portion 410*b* includes multiple bottom brackets 450, multiple coupled solid panels 430*b*, and one or more vertical brackets 460*b*. The glass wall module portion includes a top bracket 440, a unitary glass panel 430*a*, and one or more vertical brackets 460*a*.

As previously introduced, the interfacing features 445 of the top bracket 440 of the glass wall module portion 410*a* can be similar to the interfacing features (e.g., 345, FIG. 3) of a solid wall module portion (e.g., 310*a*, FIG. 3). As a result, the solid wall module portion 410*b* can interface with and be stacked upon the glass wall module portion 410*a*. In particular, the interfacing features 445 of the top bracket 440 can include angular surfaces to interface with and support the corresponding angular surfaces of the solid panels 430*b* to hold the solid wall module portion 410*b* in place on top of the glass wall module portion 410*a*. As a result, an assembler can stabilize the solid wall module portion 410*b* on top of the glass wall module portion 410*a* and then fasten the wall module portions 410*a*, 410*b* together using one or more splice plates 415.

Figure 5:
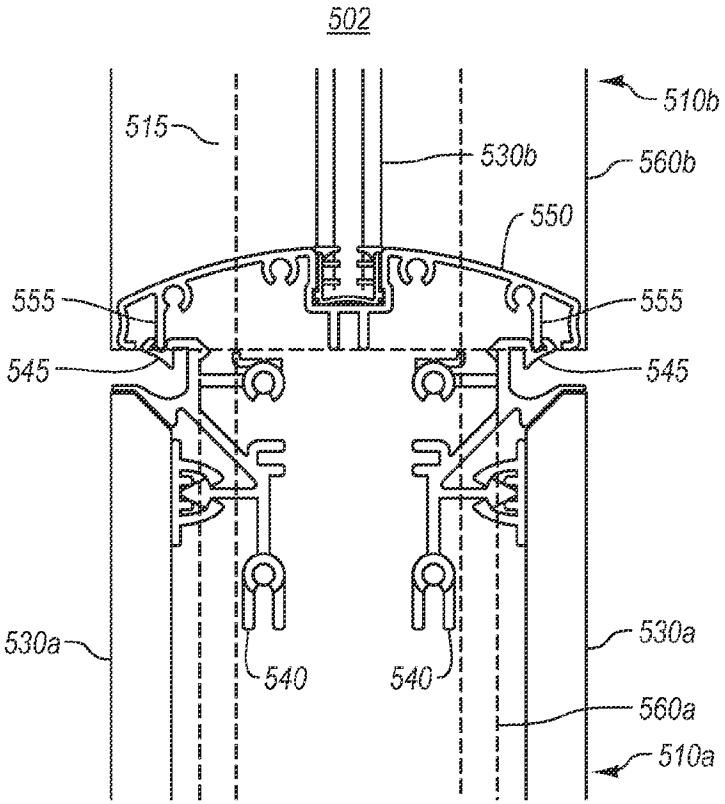
FIG. 5 illustrates a partial cross-sectional view of a full-height wall module with a glass wall portion stacked over a solid wall portion in accordance with an implementation of the present invention.

FIG. 5 illustrates a yet further embodiment of a full-height wall module 502. Similar to FIGS. 2-4, FIG. 5 illustrates a partial cross-sectional view of a wall module, specifically a full-height wall module 502. In this case, FIG. 5 illustrates a glass wall module portion 510*b* that is stacked over a solid wall module portion 510*a* in accordance with an implementation of the present invention. As illustrated in FIG. 5, the top brackets 540 of the solid wall module portion 510*a* can include interfacing features 545 to interface with the corresponding interfacing features 555 of the bottom bracket 550 of the glass wall module portion 510*b*. Accordingly, an assembler can stabilize the glass wall module portion 510*b* on top of the solid wall module portion 510*a* by positioning the interfacing features 545, 555 together to form the full-height wall module 502. Thereafter, the assembler can fasten the wall module portions 510 together using one or more splice plates 515.

Figure 6:
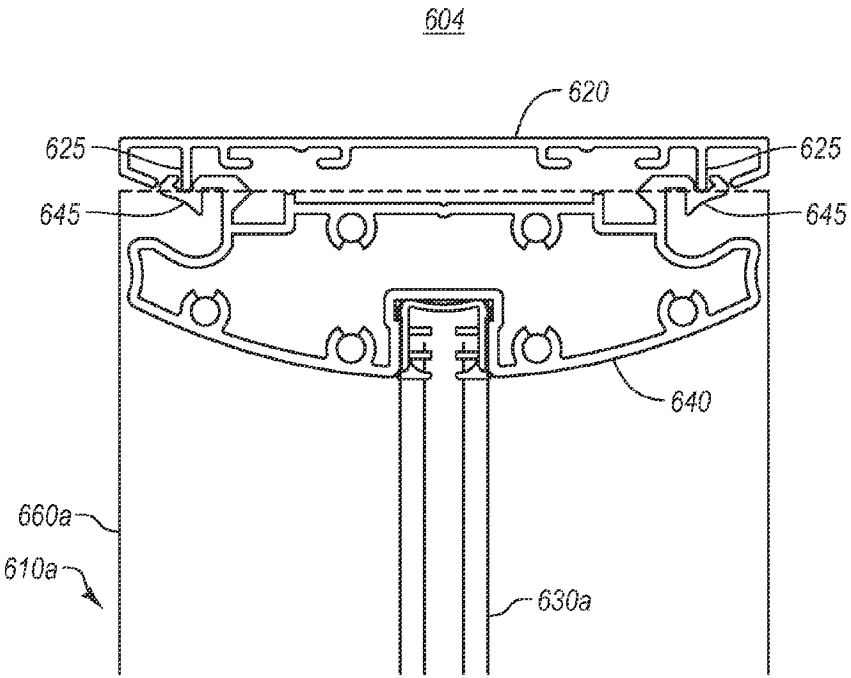
FIG. 6 illustrates a partial cross-sectional view of a solid partial-height wall module in accordance with an implementation of the present invention.

FIG. 6 illustrates an embodiment of a partial-height wall module 604 in accordance with at least one implementation of the present invention. Specifically, FIG. 6 illustrates a partial cross-sectional view of glass partial-height wall module 604 using a glass wall module portion 610*a* and a trim cap 620. As illustrated, the glass wall module portion 610*a* includes a unitary glass panel 630*a*, a top bracket 640 coupled to the top of the glass panel 630*a*, and one or more vertical brackets 660*a*. As further illustrated in FIG. 6, the trim cap 620, such as an aluminum top cap, is provided which includes interfacing features 625 on the bottom thereon that interface with the corresponding interfacing features 645 of the top bracket 640. In a further implementation of the present invention, a manufacturer can configure the trim cap 620 such that the interfacing features 625 of the trim cap 620 can clip into the corresponding interfacing features 645 of the top bracket 640 to secure the trim cap 620 in place. In any event, an assembler is able to couple the trim cap 620 to the top bracket 640 of the glass wall module portion 610*a* to form the partial-height wall module 604.

Figure 7:
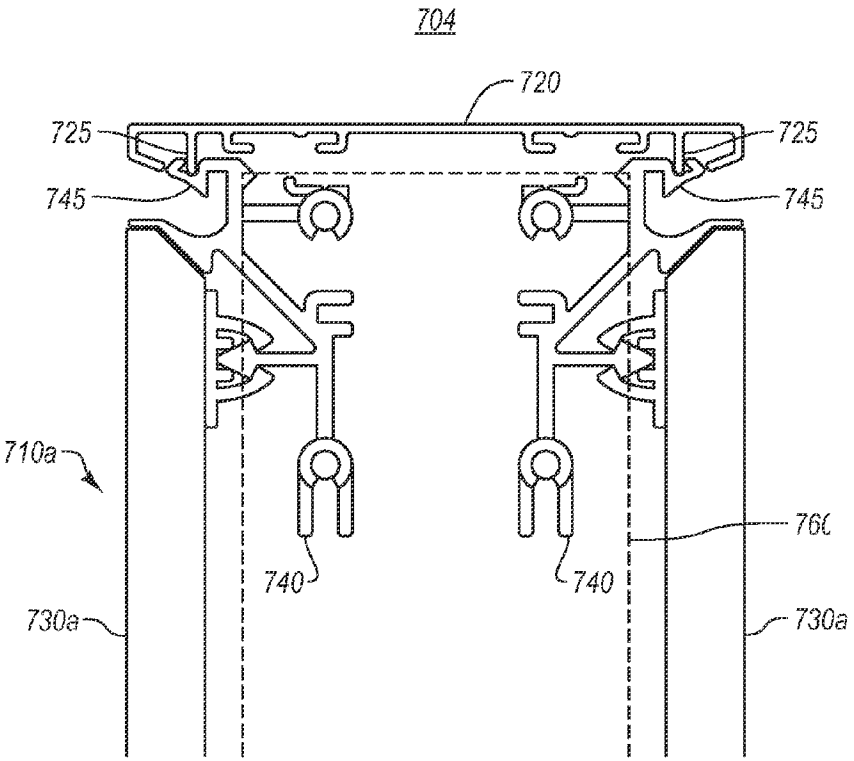
FIG. 7 illustrates a partial cross-sectional view of a glass partial-height wall module in accordance with an implementation of the present invention.

Similarly, FIG. 7 illustrates a further embodiment of a partial-height wall module 704. As in the preceding Figures, FIG. 7 illustrates a partial cross-sectional view of a wall module, in this case a partial-height wall module 704. In particular, FIG. 7 illustrates a partial-height wall module 704 using a solid wall module portion 710*a* and a trim cap 720 in accordance with an implementation of the present invention. As shown, the solid wall module portion 710*a* includes coupled solid panels 730*a*, top brackets 740 coupled to the tops of the solid panels 730*a*, and a vertical bracket 760*a*. As further illustrated in FIG. 7, the trim cap 720 includes interfacing features 725 on the bottom thereon that interface with corresponding interfacing features 745 on the top of the top brackets 740. As a result, and similar to FIG. 6, an assembler can position the trim cap 720 on the top brackets 740 of the solid wall module portion 710*a* to form the partial-height wall module 704.

In accordance with the above disclosure and the elements illustrated in the Figures, and referring again to FIG. 1, a manufacturer/assembler can perform a method of creating partial 104 or full-height 102 wall modules. In particular, a manufacturer/assembler can perform a step of placing a lower wall module portion 110*a* in a location where a partial 104 or full-height wall module 102 is desired. As discussed in more detail above, the lower wall module portion 110*a* can include a top bracket 140 configured to interface with a trim cap 120 to form a partial-height wall module 104 or with the bottom surface of an additional upper wall module portion 110*b*, 110*c* to form a full-height wall module 102. Thereafter, the manufacturer/assembler can perform at least one of stacking an upper wall module portion 110*b*, 110*c* on top of the lower wall module portion 110*a* to create a full-height wall module 102 or coupling a trim cap 120 to the top surface of the lower wall module portion 110*a* to create a partial-height wall module 104.

The present invention can be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. In an architectural design environment that includes one or more modular walls, a stackable modular wall system configured to provide both partial-height and full-height wall modules, the stackable modular wall system comprising:

a plurality of wall module portions, at least some of which have vertical brackets configured to be individually mountable on one or both opposing edges thereof, at least some of which have bottom brackets configured to be individually mountable on the bottom edges thereof, and all of which have top brackets configured to be individually mountable on the top edges thereof;

at least some of the wall module portions comprising solid panels on the front and back, and at least some of the wall module portions comprising a glass panel held between the opposing vertical, top and bottom brackets;

wherein brackets used to secure glass panels comprise first and second types of brackets different from one another, the first type being configured as a top bracket for a glass panel, and the second type being configured as a bottom bracket for a glass panel;

wherein brackets used to secure solid panels comprise first and second types of brackets different from another and different from the brackets used to secure glass panels, the first type being configured as a top bracket for a solid panel and the second type being configured as a bottom bracket for a solid panel, such that wall module portions with glass panels can be stacked on top of wall module portions with solid panels and vice versa, depending on which bracket type is used for top and bottom placement on a given wall module portion; and each of the wall module portions being of equal size and dimension so as to be stackable irrespective of whether wall modules portions with glass panels are stacked on wall module portions with solid panels or vice versa so as to form individual modules comprised of either full height modules or partial height modules depending on how many wall module portions are vertically stacked on top of one another.

2. The system as recited in claim 1, wherein the wall module portions with glass panels are upper wall module portions comprising a center mounted glass panel.

3. The system as recited in claim 1, further comprising a trim cap configured to interface with the top bracket of a lower wall module portion used to form a partial-height wall module.

4. The system as recited in claim 1, wherein the wall module portions having a bottom bracket are interchangeable as a lower wall module portion or as an upper wall module portion.

5. The system as recited in claim 1, wherein the vertical brackets are configured to couple partial-height wall modules to full-height wall modules.

6. The system as recited in claim 1, wherein a full-height wall module is formed using one of the wall module portions as one lower wall module portion and a plurality of other wall module portions as upper wall module portions.

7. The system as recited in claim 1, further comprising one or more splice plates for securing a lower wall module portion to an upper wall module portion.

8. The system as recited in claim 1, wherein multiple wall module portions are used as lower wall module portions coupled together such that multiple wall modules can be coupled together regardless of whether they are full-height or partial-height wall modules.

9. In an architectural design environment that includes one or more modular walls, a stackable wall module system configured to provide both partial-height and full-height wall modules, the stackable wall module system comprising:

a plurality of wall module portions, at least some of which have vertical brackets configured to be individually mountable on one or both opposing edges thereof, at least some of which have bottom brackets configured to be individually mountable on the bottom edges thereof, and all of which have top brackets configured to be individually mountable on the top edges thereof;

at least some of the wall module portions comprising solid panels on the front and back, and at least some of the wall module portions comprising a glass panel held between the opposing vertical, top and bottom brackets;

wherein the top and bottom brackets used to secure glass panels are configured to secure and hold the glass panels at the center of each such bracket, and the top and bottom brackets used to secure solid panels are configured to secure and hold the solid panels at the outer edges of each such bracket; and wherein the bottom brackets of the glass panels and the solid panels are configured differently such that, in the case of a solid wall module, only the opposing solid panels of the solid wall module and not the corresponding bottom bracket itself contact the top bracket of a lower glass wall module or a lower solid wall module, and, in the case of a glass wall module, the bottom bracket directly contacts and engages the top bracket of the lower glass wall module or of the lower solid wall module; and each of the wall module portions being of equal size and dimension so as to be stackable irrespective of whether wall modules portions with glass panels are stacked on wall module portions with solid panels or vice versa so as to form individual modules comprised of either full height modules or partial height modules depending on how many wall module portions are vertically stacked on top of one another.

10. The stackable wall module system as recited in claim 9, further comprising a trim cap configured to directly mount to the top bracket of wall module portions used to form a partial-height wall module.

11. The system as recited in claim 9, wherein the wall module portions with glass panels are upper wall module portions.

12. The system as recited in claim 9, wherein the wall module portions having a bottom bracket are interchangeable as a lower wall module portion or as an upper wall module portion.

13. The system as recited in claim 9, wherein the vertical brackets are configured to couple partial-height wall modules to full-height wall modules.

14. The system as recited in claim 12 wherein a full-height wall module is formed using one of the wall module portions as one lower wall module portion and a plurality of other wall module portions as upper wall module portions.

15. The system as recited in claim 14, further comprising one or more splice plates for securing a lower wall module portion to an upper wall module portion.

16. The system as recited in claim 9, wherein the bottom brackets for securing the glass panels comprise a plurality of interfacing features configured for direct contact and engagement with opposing interfacing features in the top brackets of the lower glass wall module or the top brackets of the lower solid wall module.

17. The system as recited in claim 9, wherein the top brackets of the lower solid wall module are configured with a plurality of interfacing features that, in the case of an upper solid wall module, engage and align only the bottom edges of the corresponding solid panels.

18. The system as recited in claim 17, wherein bottom edges of the corresponding solid panels comprise angular surfaces for engaging the plurality of interfacing features in the top brackets of the lower solid wall module.

19. In an architectural design environment that includes one or more modular walls, a stackable modular wall system configured to provide both partial-height and full-height wall modules, the stackable modular wall system comprising:

a plurality of wall module portions, at least some of which have vertical brackets configured to be individually mountable on one or both opposing edges thereof, at least some of which have bottom brackets configured to be individually mountable on the bottom edges thereof, and all of which have top brackets configured to be individually mountable on the top edges thereof;

at least some of the wall module portions comprising opposing panels on the front and back, and at least some of the wall module portions comprising a single panel held between the opposing vertical, top and bottom brackets;

wherein brackets used to secure single panels comprise first and second types of brackets different from one another, the first type being configured as a top bracket for a single panel, and the second type being configured as a bottom bracket for a single panel;

wherein brackets used to secure opposing panels comprise first and second types of brackets different from another and different from the brackets used to secure single panels, the first type being configured as a top bracket for an opposing panel module, and the second type being configured as a bottom bracket for a opposing panel module, such that wall module portions with single panels can be stacked on top of wall module portions with opposing panels and vice versa, depending on which bracket type is used for top and bottom placement on a given wall module portion; and each of the wall module portions being of equal size and dimension so as to be stackable irrespective of whether wall modules portions with single panels are stacked on wall module portions with opposing panels or vice versa so as to form individual modules comprised of either full height modules or partial height modules depending on how many wall module portions are vertically stacked on top of one another.

20. The system as recited in claim 19, wherein the opposing panels comprise solid panels, and wherein the single panels comprise glass panels.

* * * * *